US008142242B2

(12) United States Patent
Whitener

(10) Patent No.: US 8,142,242 B2
(45) Date of Patent: Mar. 27, 2012

(54) MARINE PROPULSION SYSTEM

(75) Inventor: Philip C. Whitener, Bainbridge Island, WA (US)

(73) Assignee: Advanced Marine Concepts, LLC, Bainbridge Island, WA (US)

( * ) Notice: Subject to any disclaimer, the term of this patent is extended or adjusted under 35 U.S.C. 154(b) by 120 days.

(21) Appl. No.: 12/454,581

(22) Filed: May 19, 2009

(65) Prior Publication Data

US 2010/0297895 A1 Nov. 25, 2010

(51) Int. Cl.
*B63H 11/00* (2006.01)

(52) U.S. Cl. ..... 440/38

(58) Field of Classification Search ..... 440/6, 38, 440/40, 47, 66, 67, 76; 415/1, 90, 120
See application file for complete search history.

(56) References Cited

U.S. PATENT DOCUMENTS

| | | | | |
|---|---|---|---|---|
| 3,171,355 | A | 3/1965 | Harris et al. | |
| 3,299,815 | A | 1/1967 | Thaw | |
| 3,348,514 | A | 10/1967 | Davis | |
| 3,545,399 | A | 12/1970 | Adam | |
| 3,745,959 | A | 7/1973 | Coffey et al. | |
| 4,067,665 | A | 1/1978 | Schwartzman | |
| 4,073,258 | A | 2/1978 | Logan | |
| 4,240,370 | A | 12/1980 | Lubin | |
| 4,974,539 | A | 12/1990 | Duffty et al. | |
| 4,993,977 | A | 2/1991 | Rodler, Jr. | |
| 5,456,574 | A | 10/1995 | Donnelly et al. | |
| 6,375,412 | B1 * | 4/2002 | Dial | 415/90 |
| 6,779,964 | B2 * | 8/2004 | Dial | 415/1 |
| 7,341,424 | B2 * | 3/2008 | Dial | 415/90 |

FOREIGN PATENT DOCUMENTS

| | | |
|---|---|---|
| JP | 62037296 | 2/1987 |
| JP | 05319358 | 12/1993 |

OTHER PUBLICATIONS

Dorota Z. Haman, Forrest T. Izuno, and Allen G. Smajstrla, Pumps for Florida Irrigation and Drainage Systems, Circular 832, Florida Cooperative Extension Service, Institute of Food and Agricultural Sciences, University of Florida, first published Jul. 1989, revised Jan. 1994.

* cited by examiner

*Primary Examiner* — Daniel Venne

(57) ABSTRACT

Illustrative marine propulsion systems are disclosed. In a non-limiting, illustrative embodiment, a marine propulsion system includes a pump housing that is configured to be disposed below a waterline of a marine vessel and a centrifugal pump assembly that is disposed in the pump housing. The centrifugal pump assembly includes an inlet pump stage configured to receive inlet water and to discharge impulse water. The centrifugal pump assembly also includes an outlet pump stage that includes an impulse turbine wheel configured to rotate about an axis responsive to the impulse water and an outlet pump stage impeller integral with the impulse turbine wheel. The outlet pump stage impeller is configured to rotate about the axis.

19 Claims, 8 Drawing Sheets

MARINE PROPULSION SYSTEM

BACKGROUND

In some pump applications, it may be desirable to pump a relatively large volume of water at a relatively low pressure. Some examples of such applications may include marine vessel propulsion and irrigation systems. It is also desirable for the pump to operate efficiently.

However, in some cases, unavoidable inefficiencies may be introduced. For example, in a jet propulsion system for hydrofoil marine vessels, the inlet must be located below the hydrofoils. If the propulsion system is located in the hull, then water must be raised from the inlet to the pump, thereby reducing inlet pressure, adding other unrecoverable losses, and introducing undesirable pitching moments resulting from the high thrust line. Increasing efficiency in such cases entails matching a ratio of pump outlet flow velocity to marine vessel velocity. However, matching velocity ratios for efficiency currently involves large gears, large pumps, and large water flows.

The foregoing examples of related art and limitations associated therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems and methods which are meant to be illustrative, not limiting in scope. In various embodiments, one or more of the problems described above in the Background have been reduced or eliminated, while other embodiments are directed to other improvements.

In a non-limiting, illustrative embodiment, a marine propulsion system includes a pump housing that is configured to be disposed below a waterline of a marine vessel and a centrifugal pump assembly that is disposed in the pump housing. The centrifugal pump assembly includes an inlet pump stage configured to receive inlet water and to discharge impulse water. The centrifugal pump assembly also includes an outlet pump stage that includes an impulse turbine wheel configured to rotate about an axis responsive to the impulse water and an outlet pump stage impeller integral with the impulse turbine wheel. The outlet pump stage impeller is configured to rotate about the axis.

According to a non-limiting, illustrative aspect, the inlet pump stage can include an inlet pump stage impeller that is configured to rotate about the axis. According to another non-limiting, illustrative aspect, the impulse turbine wheel and the outlet pump stage impeller can be portions of a single assembly. According to another non-limiting, illustrative aspect, the impulse turbine wheel and the output pump stage impeller can be separate components that are attached to each other. According to another non-limiting, illustrative aspect, the inlet pump stage can be configured to discharge the impulse water at a first pressure and a first volume flow rate, the impulse turbine wheel can be configured to discharge water at a second pressure that is less than the first pressure, and the outlet pump stage impeller can be configured to discharge water at the second pressure and a second volume flow rate that is proportionally greater than the first volume flow rate.

In another non-limiting, illustrative embodiment, a marine propulsion system includes a pump housing that is configured to be disposed below a waterline of a marine vessel. The pump housing defines an inlet port and an outlet nozzle. The marine propulsion system also includes a centrifugal pump assembly that is disposed in the pump housing. The centrifugal pump assembly includes an inlet pump stage that is configured to receive inlet water from the inlet port of the pump housing and to discharge impulse water. The centrifugal pump assembly also includes an outlet pump stage. The outlet pump stage includes an impulse turbine wheel that is configured to rotate about an axis responsive to the impulse water and to discharge water to the outlet nozzle. The outlet pump stage also includes an outlet pump stage impeller that is integral with the impulse turbine wheel. The outlet pump stage impeller is configured to rotate about the axis and to discharge water to the outlet nozzle.

In another non-limiting, illustrative embodiment, a centrifugal pump impeller assembly includes an impulse turbine wheel that is configured to rotate about an axis and a centrifugal pump impeller that is integral with the impulse turbine wheel. The centrifugal pump impeller is configured to rotate about the axis.

In addition to the illustrative embodiments and aspects described above, further embodiments and aspects will become apparent by reference to the drawings and by study of the following detailed description.

BRIEF DESCRIPTION OF THE DRAWINGS

Illustrative embodiments are illustrated in referenced figures of the drawings. It is intended that the embodiments and figures disclosed herein are to be considered illustrative rather than restrictive.

DETAILED DESCRIPTION

By way of overview, illustrative marine propulsion systems are disclosed. In some illustrative embodiments, a marine propulsion system can efficiently convert rotary motion of a prime mover operating near a maximized or optimized efficiency with or without intermediate gearing to a centrifugal pump assembly that can match the flow and velocity of a discharged water jet to a marine vessel's speed for maximized propulsive efficiency. Applications for such an illustrative embodiment of a marine propulsion system can include a propulsion system for any type of marine vessel, such as without limitation a hydrofoil. Other applications of an illustrative embodiment of a marine propulsion system include an outboard motor for a marine vessel, such as without limitation a boat. Illustrative embodiments of a centrifugal pump impeller assembly suitably may be applied to any application whatsoever in which efficient conversion of energy from a high-pressure source is desired.

Figure 1A:
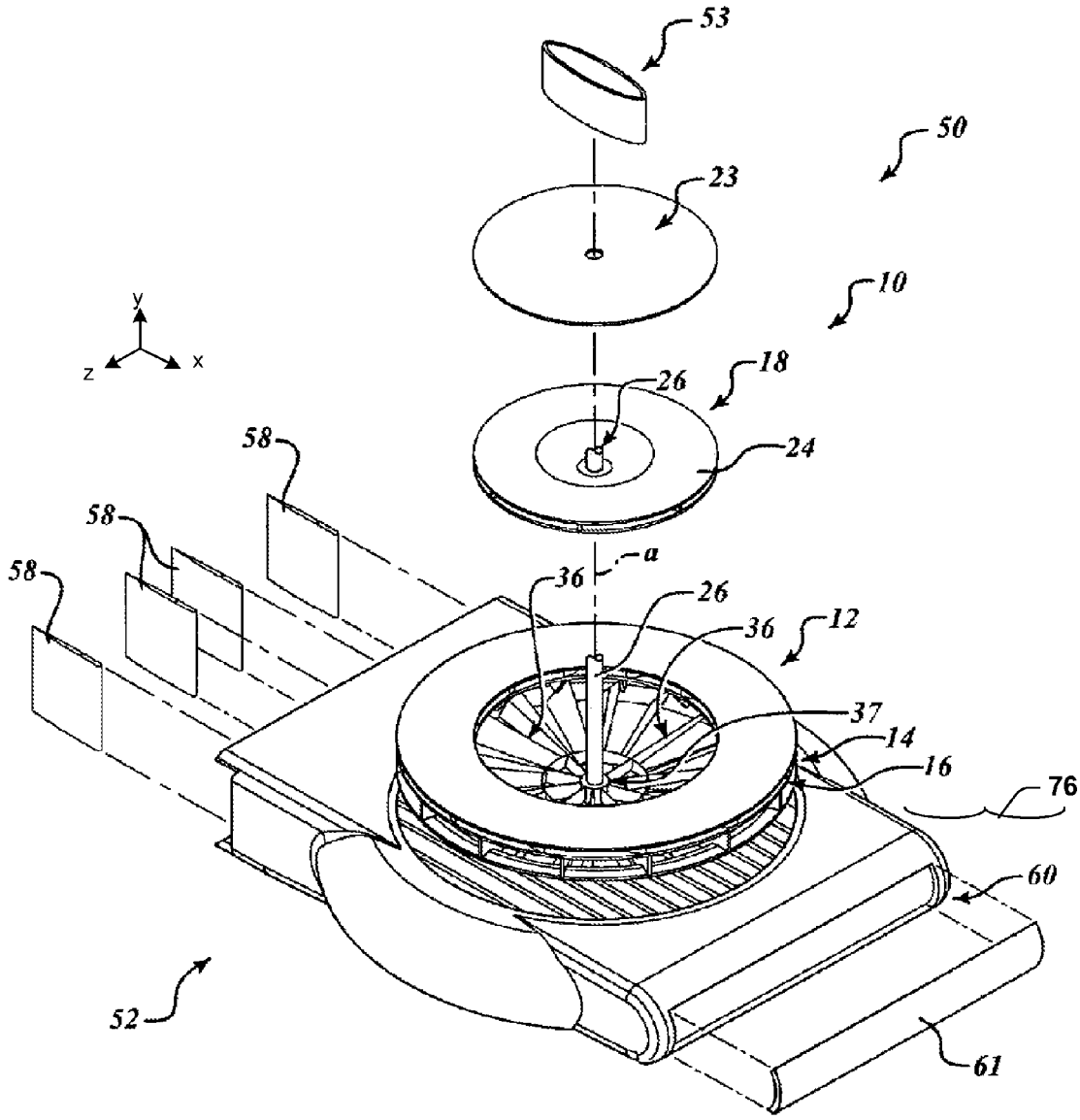
FIG. 1A is an exploded perspective view of an illustrative marine propulsion system.

Still by way of overview and referring to FIG. 1A, in a non-limiting, illustrative embodiment, a marine propulsion system 50 is provided. The marine propulsion system 50 includes a pump housing 52 that is configured to be disposed below a waterline of a marine vessel (not shown) and a centrifugal pump assembly 10 that is disposed in the pump housing 52. The centrifugal pump assembly 10 includes an inlet pump stage 18 configured to receive inlet water and to discharge impulse water. The centrifugal pump assembly 10 also includes an outlet pump stage 14 that includes an impulse turbine wheel 12 configured to rotate about an axis a responsive to the impulse water and an outlet pump stage impeller 16 integral with the impulse turbine wheel 12. The outlet pump stage impeller 16 is configured to rotate about the axis a.

Still by way of overview, it will be appreciated that the impulse turbine wheel 12 is driven by the impulse water (as will be explained below). Because the impeller 16 of the outlet pump stage 14 is integral with the impulse turbine wheel 12, rotation of the impulse turbine wheel 12 causes rotation of the impeller 16 of the outlet pump stage 14. Illustrative details of non-limiting embodiments will be set forth below.

Figure 1B:
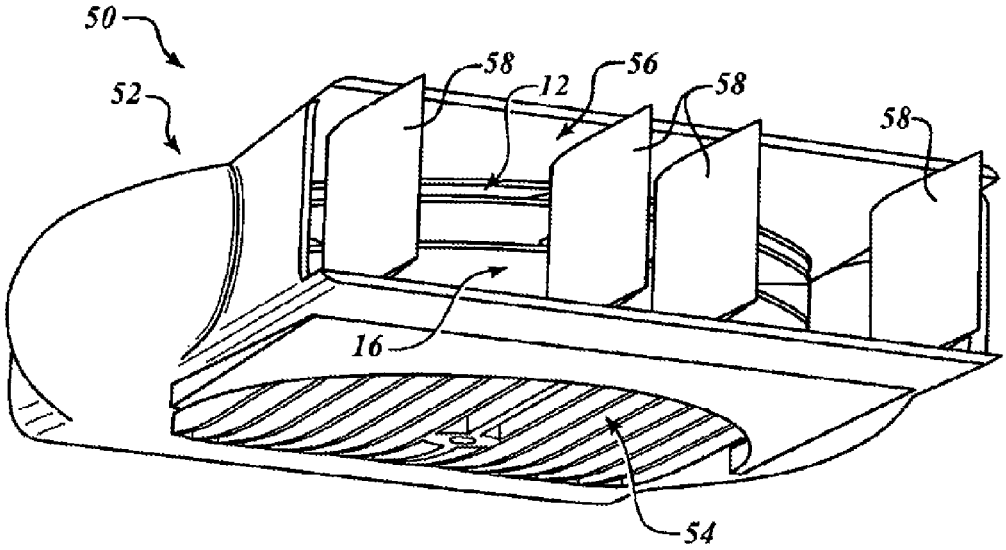
FIGS. 1B and 1C are perspective views of the illustrative marine propulsion system of FIG. 1A.
Figure 1C:
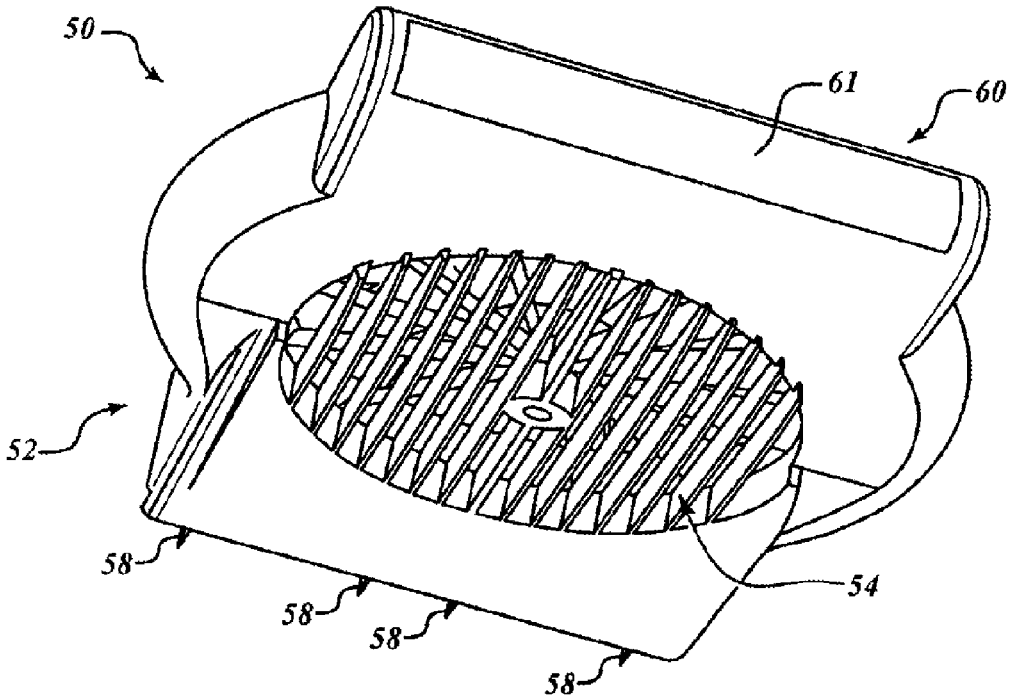

Referring additionally to FIGS. 1B and 1C, the pump housing 52 is configured to be disposed below a waterline of a marine vessel. In some embodiments, the pump housing 52 may be located near, at, or below a plane of a foil for a hydrofoil. Given by way of non-limiting example, the pump housing 52 may be attached to a strut, a portion of which is represented generally at 53 (FIG. 1A). The pump housing 52 defines an inlet port 54 and an outlet nozzle 56 (FIG. 1B). In some embodiments, the inlet port 54 may be defined in an underside of the pump housing 52 and the outlet nozzle 56 may be defined in an aft portion of the pump housing 52. It will be appreciated that locating the inlet port 54 in the underside of the pump housing 52 can help maximize pressure recovery. The centrifugal pump 10 is disposed in the pump housing 52.

In some embodiments, if desired the pump housing 52 may include steerable deflector vanes 58 configured to deflect water discharged from the outlet nozzle 56 in a yaw plane (e.g., an x-z reference plane of FIG. 1). Thus, the steerable deflector vanes 58 can help provide a means for steering and/or maneuvering the marine vessel. In other embodiments the entire marine propulsion system 50 may be rotated for steering.

In some embodiments, if desired the pump housing 52 can include a closeably openable reverse thrust port 60. In some embodiments the reverse thrust port 60 may be defined in a forward portion of the pump housing 52. The reverse thrust port 60 is configured to discharge therethrough at least a portion of outlet water discharged from the outlet pump stage 14. The reverse thrust port 60 can be opened and closed with a cover 61. When the reverse thrust port 60 is opened, a portion of the outlet water discharged from the outlet pump stage 14 can be discharged in a direction substantially opposite that of the water discharged from the outlet nozzle 56 of the pump housing 52. In addition, if desired the steerable deflector vanes 58 may be closed. Closing the steerable deflector vanes 58 reduces the amount of outlet water discharged through the outlet nozzle 56, thereby increasing the amount of outlet water available for discharge through the reverse thrust port 60 for reverse thrust purposes. Thus, reverse thrust can be provided, thereby helping to slow forward motion of the marine vessel.

Figure 2:
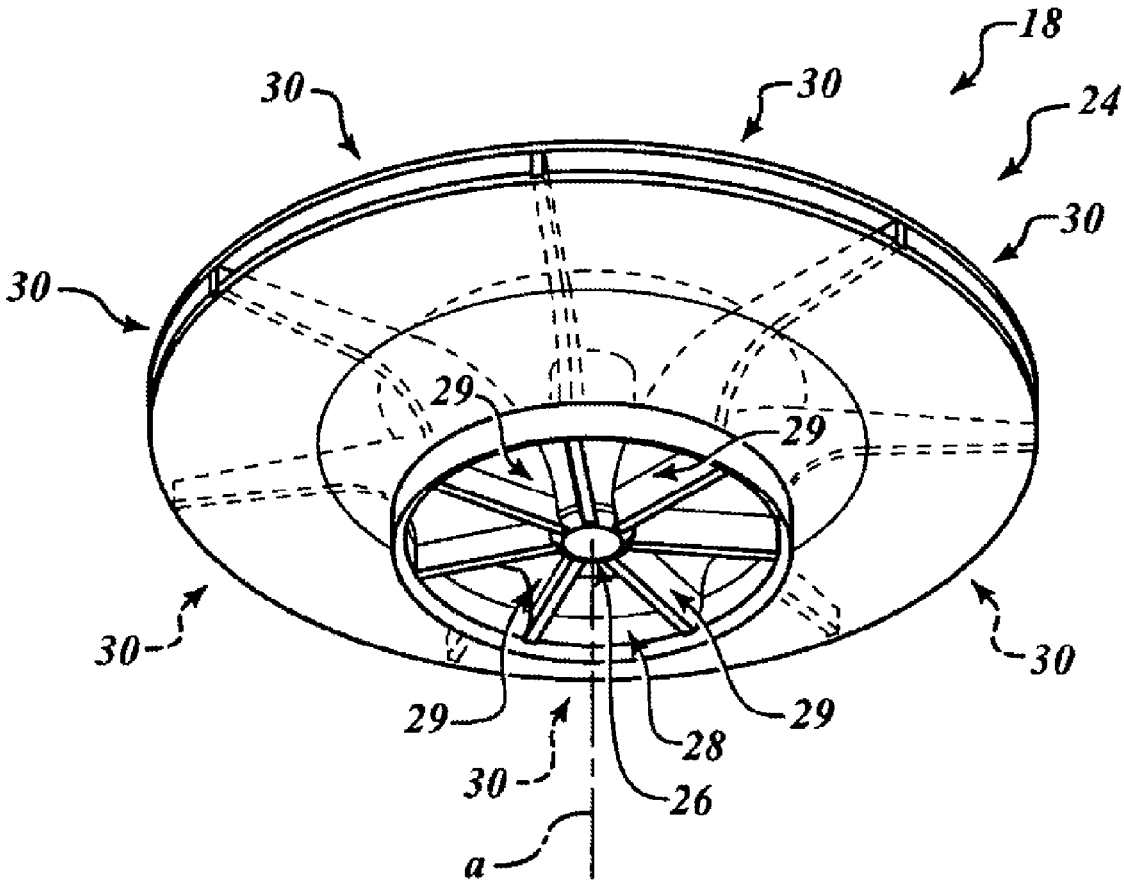
FIG. 2 is a perspective view of an illustrative inlet pump stage.

Referring additionally to FIG. 2, in some embodiments the inlet pump stage 18 includes an inlet pump stage impeller 24 that is configured to rotate about the axis a. The impeller 24 discharges the impulse water at a first pressure.

In some embodiments the impeller 24 is operationally coupled for rotation by a prime mover that is located distal or remote from the inlet pump stage 18. For example, as shown in FIG. 1, the impeller 24 may be rotated by an engine of a marine vessel. Given by way of illustration and not of limitation, the centrifugal pump 10 may be located near, in, or below a plane of a foil (not shown) of a hydrofoil (not shown). In such an application the prime mover may be an internal combustion engine or a jet engine that rotates a shaft 26 about the axis a with or without intermediate gearing. It will be appreciated that configurations of some embodiments may use an engine with a horizontal shaft. Such configurations thus entail use of a right angle gear. However, weight and cost impact of such gearing is minimal. The shaft 26 is sealed with a shaft seal 23 (FIG. 1A). In some embodiments the shaft seal 23 suitably is also a cover for a portion of the pump housing 52. The shaft 26 is attached to the impeller 24 in any manner as desired. For example, the shaft 26 can be integral, keyed, or splined. The shaft 26 is axially restrained at an upper end and a lower end by bearings (not shown) in the pump housing 52. The upper end of the shaft 26 can be driven by a spline or coupling (not shown) on the shaft 26 that is rotated by the prime mover. Thus, rotation of the shaft 26 causes rotation of the attached impeller 24 about the axis a at the speed of rotation of the shaft 26. In such embodiments the inlet pump stage 18 suitably is sized to absorb the drive output of the prime mover engine with no or minimal gearing. As will be discussed in detail further below, selection of the first pressure and the first volume flow rate for obtaining a most efficient (or at least an optimized) jet velocity ratio for propulsion is influenced by optimizing performance of the inlet pump stage 18 and the impulse turbine wheel 12.

In some other embodiments, the impeller 24 may be operationally coupled for rotation by a prime mover that is located proximate the inlet pump stage 18. For example, as shown in FIG. 1, the inlet pump stage 18 may include an electric motor 74 that is configured to rotate the impeller 24. In such an application and given by way of non-limiting example, a stator winding (not shown) may be provided in the vicinity of the impeller 24 and may be electrically connected to an electrical source (not shown). The impeller 24 may include permanent magnets, thereby defining a rotor of a DC electric motor.

Regardless of location or type of prime mover that rotates the impeller 24, the impeller 24 includes an inlet port 28, vanes 29, and discharge ports 30. The inlet port 28 is coaxial with the axis a and the discharge ports 30 are substantially normal to the axis a. The impeller 24 rotates about the axis a at the rotational speed of the prime mover. The inlet pump stage 18 is in hydraulic communication with the inlet port 54 of the pump housing 52, and the impeller 24 is configured to receive inlet water from the inlet port 54 of the pump housing 52 via the inlet port 28 of the inlet pump stage 18. Inlet water enters through the inlet port 28, is accelerated by the vanes 29 during Rotation about the axis a, and is discharged at the first pressure and a first volume flow rate as the impulse water through the discharge ports 30. Because of relative positioning of the discharge ports 30 and the impulse turbine wheel 12, the impulse water that is discharged at the first pressure through the discharge ports 30 is discharged in hydraulic communication into the impulse turbine wheel 12.

Figure 3A:
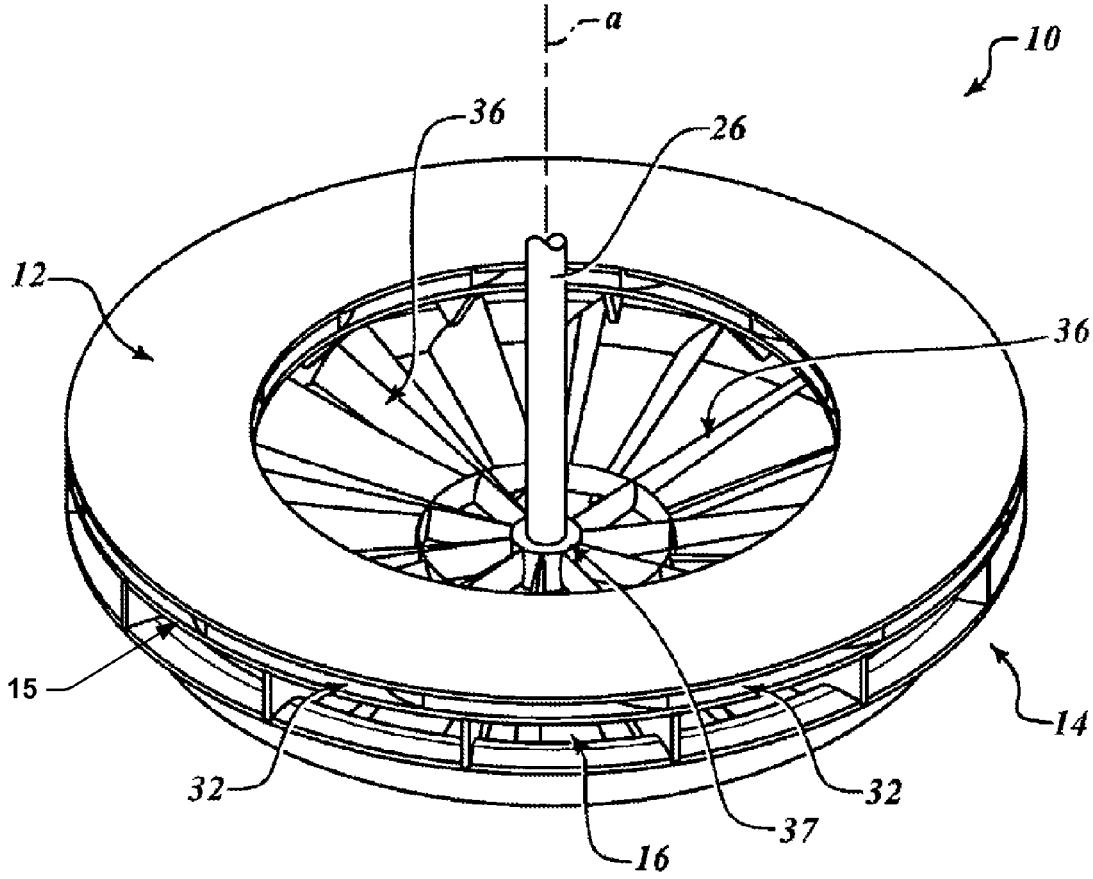
FIGS. 3A and 3B are perspective views of an illustrative centrifugal pump impeller assembly including an integral turbine.
Figure 3B:
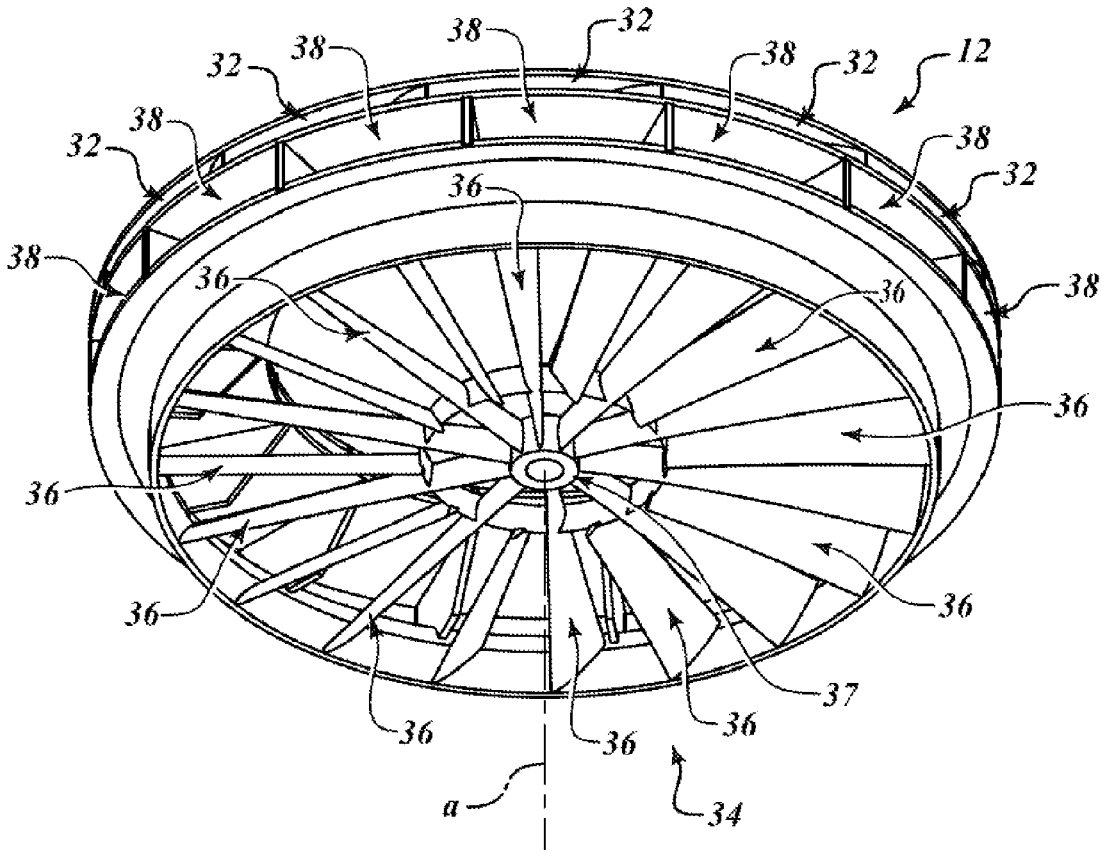
Figure 4:
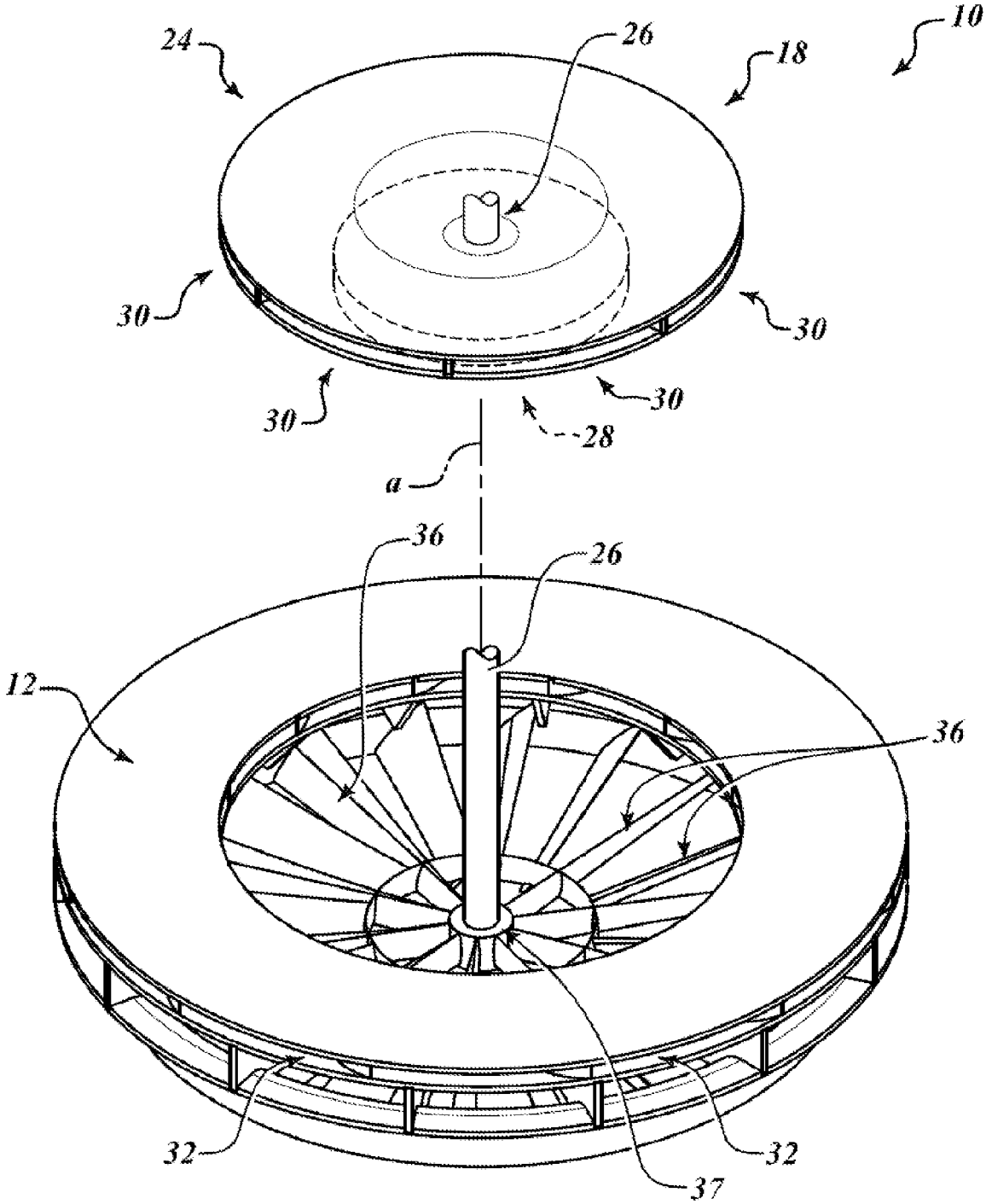
FIG. 4 is an exploded perspective view of the inlet pump stage of FIG. 2 and the centrifugal pump impeller assembly of FIGS. 3A and 3B.

Referring additionally to FIGS. 3A, 3B, and 4, the impulse turbine wheel 12 is rotated by absorbing energy from the impulse water. The impulse turbine wheel 12 has an annular inlet around the discharge ports 30 of the impeller 24 of the inlet pump stage 18. The outlet pressure of the inlet pump stage 18—that is, the first pressure—is the inlet pressure of the impulse turbine wheel 12. The impulse water is discharged from the inlet pump stage 18 into the annular inlet of the impulse turbine wheel 12 at the first volume flow rate. The impulse turbine wheel 12 thus absorbs energy from impulse water that is discharged through the discharge ports 30 of the impeller 24 at the first pressure and the first volume flow rate. It will be appreciated that, in such embodiments with no piping between the inlet pump stage 18 and the impulse turbine wheel 12, the impeller 24 and the impulse turbine wheel 12 can be hydraulically coupled to each other without experiencing piping losses.

The impulse turbine wheel 12 suitably is any impulse turbine known in the art. Given by way of non-limiting example, in some embodiments, the impulse turbine wheel 12 is a Pelton turbine wheel. Spoon-shaped buckets 32 are mounted around an interior of an edge of the impulse turbine wheel 12. As the impulse water flows into the bucket 32, the direction of the impulse water velocity changes to follow the contour of the bucket 32. When the impulse water contacts the bucket 32, the impulse water exerts pressure on the bucket 32 and the impulse water is decelerated as it does a "u-turn" and flows out the other side of the bucket 32 at a lower velocity and at a second pressure that is less than the first pressure. In the process, the impulse water's momentum is transferred to the impulse turbine wheel 12. This impulse does work on the impulse turbine wheel 12, thereby causing the impulse turbine wheel 12 to rotate about the axis a. Water is discharged from the impulse turbine wheel 12 at the second pressure.

The impeller 16 of the outlet pump stage 14 is integral with the impulse turbine wheel 12. Thus, rotation of the impulse turbine wheel 12 about the axis a causes rotation of the integral impeller 16 of the outlet pump stage 14 about the axis a. The outlet pump stage 14 is configured to discharge outlet water at the second pressure that is less than the first pressure and a second volume flow rate that is proportionally greater than the first volume flow rate. Relationships between the first pressure, the first volume flow rate, the second pressure, and the second volume flow rate will be explained further below.

The impeller 16 of the outlet pump stage 14 suitably is a centrifugal pump impeller. The outlet pump stage 14 includes an inlet port 34, vanes 36, and discharge ports 38. The vanes 36 are attached to a central retaining sleeve 37. The shaft 26 is freely received within the retaining sleeve 37 without being attached to the retaining sleeve 37. However, the impeller 16 is axially constrained on the shaft 26. Thus, the shaft 26 can rotate freely without causing the unattached retaining sleeve 37 to rotate. The impeller 16 thus is not directly rotated by the shaft 26. The inlet port 34 is coaxial with the axis a and the discharge ports 38 are substantially normal to the axis a. The outlet pump stage 14 is in hydraulic communication with the inlet water. The inlet port 34 of the outlet pump stage 14 receives the inlet water through the inlet port 54 defined in the pump housing 52. Thus, in some embodiments the inlet pump stage 18 and the outlet pump stage 14 both receive the inlet water through a common inlet—that is, the inlet port 52 of the pump housing 50. The impeller 16 rotates about the axis a at the rotational speed of the impulse turbine wheel 12. Inlet water enters through the inlet port 34, is accelerated by the vanes 36 during rotation about the axis a, and is discharged through the discharge ports 38.

The impeller 16 is integral with the impulse turbine wheel 12. Thus, the impeller 16 rotates about the axis a at the speed of rotation of the impulse turbine wheel 12. In some embodiments the impeller 16 can be integral with the impulse turbine wheel 12 by being portions of a single assembly. For example, a lower disc of the impulse turbine wheel 12 can also be a top disc of the impeller 16. In some other embodiments, the impeller 16 can be integral with the impulse turbine wheel 12 by being separate components that are attached to each other. For example, the bottom disc of the impulse turbine wheel 12 and the top disc of the impeller 16 can be attached to each other as desired, such as by welding (e.g. along weld 15 of FIG. 3A), with fasteners or the like. That is, the impulse turbine wheel 12 can be mounted on the impeller 16. In such embodiments, it is desirable to minimize any leakage that may occur between the bottom disc of the impulse turbine wheel 12 and the top disc of the impeller 16.

Thus, in an illustrative hydrofoil marine propulsion application given by way of example and not of limitation, an inlet pump stage located in a pump housing below the foils is driven with a vertical shaft rotating at engine speed. An inlet located in the pump housing below an impeller of the inlet pump stage helps permit maximized pressure recovery. The output of the inlet pump stage drives a coaxial turbine mounted on an impeller of an outlet pump stage using impulse water via an annular inlet around the outlet of the inlet pump stage. The output of the outlet pump stage and the turbine exit through a housing and discharge port nozzle such that the volume and pressure of the discharged water jet result in an optimized velocity ratio for a jet located near the foil plane. While an illustrative hydrofoil marine propulsion application has been given by way of non-limiting example, the geometry of the centrifugal pump is configured such that the inlet and the discharge port nozzle may be embedded in a hull of a displacement vessel.

Conservation of energy principles can be applied to help tailor efficiency for a desired application. Given by way of illustration only and not of limitation, the following discussion explains conservation of energy and efficiency in the context of propulsion of a marine vessel with water discharged from the centrifugal pump 10 in which the inlet stage pump is driven by an engine of the maritime vessel. The purpose is to obtain the most efficient jet velocity ratio for propulsion.

In such a context, the following relationships exist:

$P_0$=pressure of inlet water;

$Q_1$=volume flow rate from the inlet pump stage (that is, the first volume flow rate);

$P_1$=outlet pressure of the inlet pump stage and inlet pressure of the turbine (that is, the first pressure);

$P_2$=outlet pressure of the turbine and outlet pressure of the outlet pump stage (that is, the second pressure); and $Q_2$=volume flow rate from the outlet pump stage (that is, the second volume flow rate).

In such a context output power less any input power losses is a function of outlet pressure of the outlet pump stage and volume flow rate of the turbine and the outlet pump stage. Also, required horsepower to propel the marine vessel (or boat) is a function of boat drag $D_b$ times boat velocity $V_b$. Horsepower of the jet of water discharged from the centrifugal pump is a function of jet thrust $T_j$ times jet velocity $V_j$. Thus, jet thrust $T_j$ and jet velocity $V_j$ can be defined as functions of outlet pressure of the outlet pump stage and volume flow rate of the inlet pump stage and the outlet pump stage:

$$P_0\times(Q_1+Q_2)\approx P_2\times(Q_1+Q_2) \quad (1)$$

$$D_b\times V_b=T_j\times V_j\approx P_2\times(Q_1+Q_2) \quad (2)$$

Figure 5A:
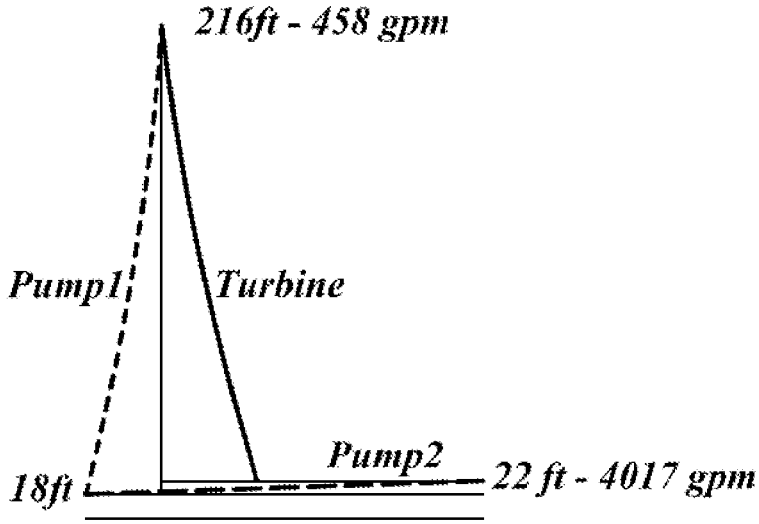
FIG. 5A is a graph illustrating the relationship of pressure and volume flow rate in an illustrative marine propulsion system.

In such an application, an objective can be to adjust the jet velocity $V_j$ by the second pressure $P_2$ and the second volume flow rate $Q_2$ to achieve an optimized and/or maximized propulsive efficiency. For example, referring to FIG. 5A by way of illustration and not of limitation, in one illustrative application the inlet pressure ($P_0$) at the inlet to the inlet pump stage and at the inlet to the outlet pump stage can be on the order of around 18 feet or so. The outlet pressure of the inlet pump stage and inlet pressure of the turbine (that is, the first pressure, or $P_1$) can be raised to a level on the order of around 216 feet or so. The volume flow rate from the inlet pump stage (that is, the first volume flow rate, or $Q_1$) can be on the order of around 458 gallons per minute or so. The outlet pressure of the turbine and outlet pressure of the outlet pump stage (that is, the second pressure, or $P_2$) can be on the order of around 22 feet or so. The volume flow rate from the outlet pump stage (that is, the second volume flow rate, or $Q_2$) can be on the order of around 4,017 gallons per minute or so.

Figure 5B:
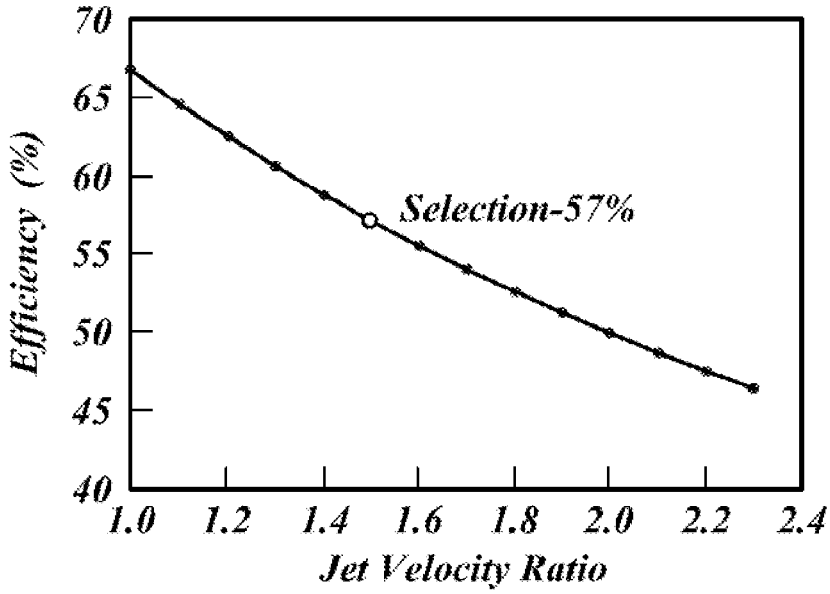
FIG. 5B is a graph illustrating the relationship of propulsive efficiency and velocity ratio of a jet and a marine vessel.

Referring additionally to FIG. 5B, the turbine and the outlet pump stage can be sized to adjust the second pressure P2 and the second volume flow rate Q2 to adjust the jet velocity Vj. The jet velocity Vj can be selected to achieve a desired ratio of jet velocity Vj to boat velocity Vb for an optimized propulsive efficiency. A maximum efficiency results when the velocity ratio is equal to one. However, it will be appreciated that pump size becomes infinite at a velocity ratio equal to one. Thus, a design objective can become an optimization objective to find the lowest velocity ratio that can be achieved with a centrifugal pump having an acceptable weight for a desired application. As shown in FIG. 5B (for the values shown in FIG. 5A), an optimized velocity ratio of around 1.5 can yield an efficiency of around 57 percent.

Figure 6:
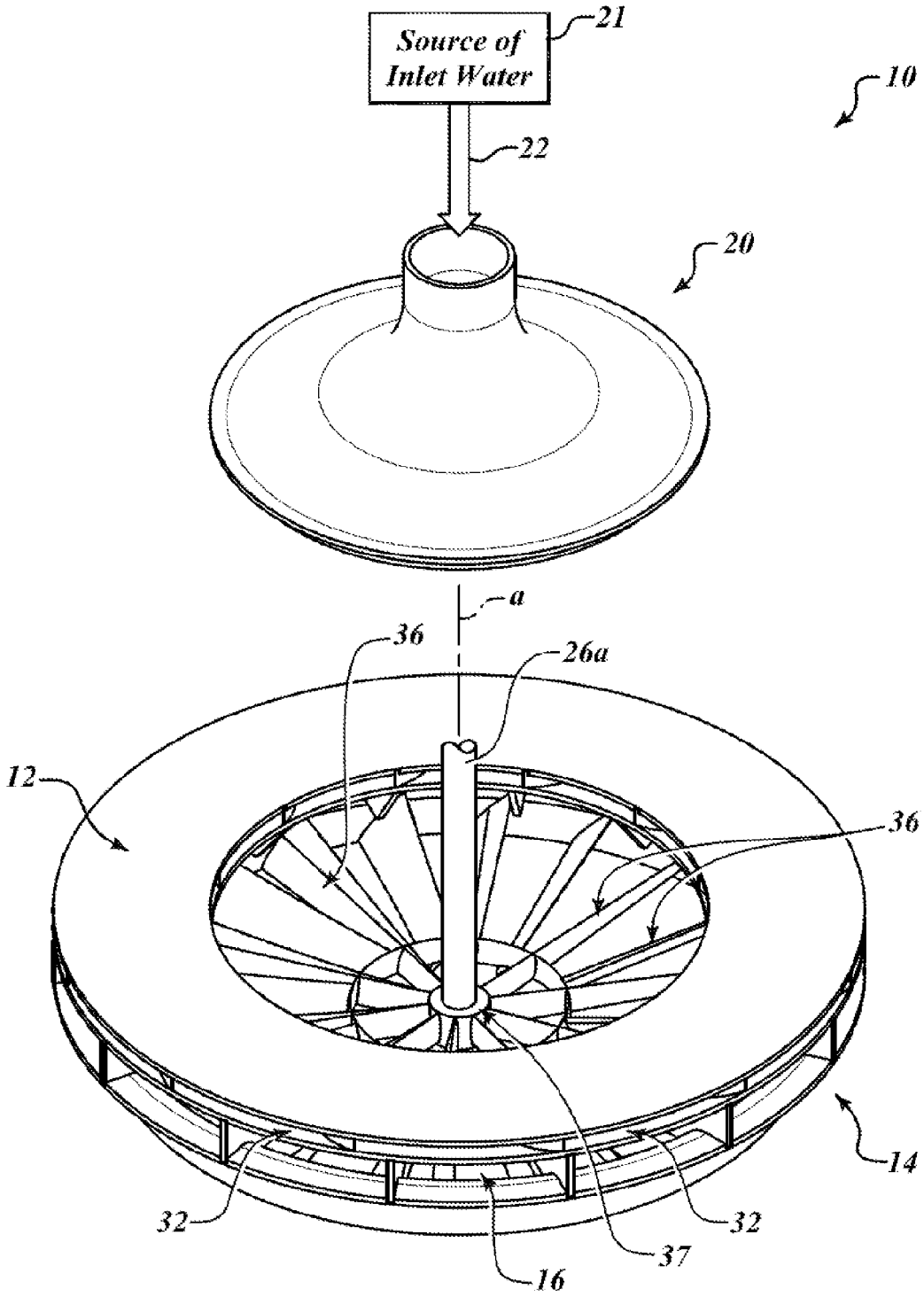
FIG. 6 is a perspective view in partial schematic form of another illustrative centrifugal pump impeller assembly with an inlet nozzle.

Referring now to FIG. 6, in some embodiments the impulse turbine wheel 12 absorbs energy from impulse water that is disbursed into the annular inlet of the impulse turbine wheel 12 from an inlet nozzle(s) 20 at the first pressure and the first volume flow rate. In such embodiments, a source 21 provides impulse water to the inlet nozzle 20. In some embodiments, the source of impulse water may be located remotely or distal from the impulse turbine wheel 12. The source 21 suitably may be any source whatsoever of water having a sufficiently high pressure for a desired application. Given by way of non-limiting examples, the source 21 may be a penstock of a hydroelectric generating plant to drive a pump to produce large flows at an appropriate pressure for irrigation applications, a seawater pump for maritime vessel applications, or the like. The inlet nozzles 20 are provided to disburse the flow of the impulse water to the impulse turbine wheel 12. The impulse turbine wheel 12 and the integral impeller 14 suitably are constructed and operate as described above. It will be noted that in some embodiments a shaft 26*a* can be stationary; that is, the shaft 26*a* need not rotate about the axis a. However, in some other embodiments the shaft 26*a* can rotate. For example, in such embodiments the shaft 26*a* can be supported at an upper end and at a lower end by bearings (not shown) and the impeller 14 can be attached to the shaft 26*a*. For example, the shaft 26*a* can be integral, keyed, or splined. The tangential inlet nozzles 20 are located proximate the annular inlet of the impulse turbine wheel 12. The inlet nozzles 20 may be any suitable type of nozzles known in the art. When provided, the inlet nozzles 20 are hydraulically coupled to the source 21 via piping 22.

While a number of illustrative embodiments and aspects have been illustrated and discussed above, those of skill in the art will recognize certain modifications, permutations, additions, and sub-combinations thereof. It is therefore intended that the following appended claims and claims hereafter introduced are interpreted to include all such modifications, permutations, additions, and sub-combinations as are within their true spirit and scope.

What is claimed is:

1. A marine propulsion system comprising:
a pump housing; and
a centrifugal pump assembly disposed in the pump housing, the centrifugal pump assembly including:
an inlet pump stage that receives inlet water and discharges impulse water, wherein the inlet pump stage includes an inlet pump stage impeller that rotates about an axis; and
an outlet pump stage including:
an impulse turbine wheel that is rotated about the axis by the impulse water; and
an outlet pump stage impeller integral with the impulse turbine wheel, wherein the outlet pump stage impeller also rotates about the axis.

2. The marine propulsion system of claim 1, wherein the impulse turbine wheel and the outlet pump stage impeller discharge water to a common discharge port.

3. The marine propulsion system of claim 1, wherein the impulse turbine wheel and the outlet pump stage impeller are portions of a single assembly.

4. The marine propulsion system of claim 1, wherein the impulse turbine wheel and the output pump stage impeller are separate components that are attached to each other.

5. The marine propulsion system of claim 4, wherein the impulse turbine wheel and the outlet pump stage impeller are welded to each other.

6. A marine propulsion system comprising:
a pump housing; and
a centrifugal pump assembly disposed in the pump housing, the centrifugal pump assembly including:
an inlet pump stage that receives inlet water and discharges impulse water, wherein the inlet pump stage discharges the impulse water at a first pressure and a first volume flow rate; and
an outlet pump stage including:
an impulse turbine wheel that rotates about an axis responsive to the impulse water, wherein the impulse turbine wheel discharges water at a second pressure that is less than the first pressure; and
an outlet pump stage impeller integral with the impulse turbine wheel, wherein the outlet pump stage impeller also rotates about the axis, and wherein the outlet pump stage impeller discharges water at the second pressure and a second volume flow rate that is proportionally greater than the first volume flow rate.

7. The marine propulsion system of claim 6, wherein the impulse turbine wheel and the outlet pump stage impeller discharge water to a common discharge port.

8. The marine propulsion system of claim 6, wherein the impulse turbine wheel and the outlet pump stage impeller are portions of a single assembly.

9. A marine propulsion system comprising:
a pump housing defining an inlet port and an outlet nozzle; and
a centrifugal pump assembly disposed in the pump housing, the centrifugal pump assembly including:
an inlet pump stage that receives inlet water from the inlet port of the pump housing and discharges impulse water, wherein the inlet pump stage includes an inlet pump stage impeller that rotates about the axis; and an outlet pump stage including:

an impulse turbine wheel that rotates about an axis responsive to the impulse water and discharges water to the outlet nozzle; and an outlet pump stage impeller integral with the impulse turbine wheel, wherein the outlet pump stage impeller rotates about the axis and discharges water to the outlet nozzle.

10. The marine propulsion system of claim 9, wherein the impulse turbine wheel and the outlet pump stage impeller are portions of a single assembly.

11. The marine propulsion system of claim 9, wherein the impulse turbine wheel and the output pump stage impeller are separate components that are attached to each other.

12. The marine propulsion system of claim 11, wherein the impulse turbine wheel and the outlet pump stage impeller are welded to each other.

13. A marine propulsion system comprising:

a pump housing defining an inlet port and an outlet nozzle; and a centrifugal pump assembly disposed in the pump housing, the centrifugal pump assembly including:

an inlet pump stage that receives inlet water from the inlet port of the pump housing and discharges impulse water, wherein the inlet pump stage discharges the impulse water at a first pressure and a first volume flow rate; and an outlet pump stage including:

an impulse turbine wheel that rotates about an axis responsive to the impulse water and to discharges water to the outlet nozzle, wherein the impulse turbine wheel discharges water at a second pressure that is less than the first pressure; and an outlet pump stage impeller integral with the impulse turbine wheel, wherein the outlet pump stage impeller rotates about the axis and discharges water to the outlet nozzle, wherein the outlet pump stage impeller discharges water at the second pressure and a second volume flow rate that is proportionally greater than the first volume flow rate.

14. The marine propulsion system of claim 13, wherein the inlet port is defined in an underside of the pump housing.

15. The marine propulsion system of claim 13, wherein the outlet nozzle is defined in an aft portion of the pump housing.

16. The marine propulsion system of claim 15, wherein the pump housing further includes at least one steerable deflector vane that deflects water discharged from the outlet nozzle in a yaw plane.

17. The marine propulsion system of claim 15, wherein the pump housing further defines a reverse thrust port defined in the pump housing and discharges therethrough at least a portion of outlet water discharged from the outlet pump stage.

18. The marine propulsion system of claim 13, wherein the impulse turbine wheel and the outlet pump stage impeller discharge water to a common discharge port.

19. The marine propulsion system of claim 13, wherein the impulse turbine wheel and the outlet pump stage impeller are portions of a single assembly.

* * * * *